US009573333B2

(12) United States Patent
Lee

(10) Patent No.: US 9,573,333 B2
(45) Date of Patent: Feb. 21, 2017

(54) DOUBLE-ACTING APPARATUS AND METHOD FOR MANUFACTURING METAL SCRAP COMPRESSION MATERIALS

(71) Applicant: Tae Ho Lee, Busan (KR)

(72) Inventor: Tae Ho Lee, Busan (KR)

( * ) Notice: Subject to any disclaimer, the term of this patent is extended or adjusted under 35 U.S.C. 154(b) by 897 days.

(21) Appl. No.: 13/977,142

(22) PCT Filed: Apr. 18, 2013

(86) PCT No.: PCT/KR2013/003320
§ 371 (c)(1),
(2) Date: Jun. 28, 2013

(87) PCT Pub. No.: WO2014/025118
PCT Pub. Date: Feb. 13, 2014

(65) Prior Publication Data

US 2014/0158003 A1 Jun. 12, 2014

(30) Foreign Application Priority Data

Aug. 10, 2012 (KR) ..... 10-2012-0087861

(51) Int. Cl.
*B30B 9/32* (2006.01)
*B30B 7/04* (2006.01)
*B30B 9/30* (2006.01)

(52) U.S. Cl.
CPC ..... *B30B 9/327* (2013.01); *B30B 7/04* (2013.01); *B30B 9/3032* (2013.01); *B30B 9/3078* (2013.01); *B30B 9/3092* (2013.01); *B30B 9/328* (2013.01)

(58) Field of Classification Search
CPC ..... B30B 7/04; B30B 9/327; B30B 9/328; B30B 9/32; B30B 9/3092; B30B 9/3021; B30B 9/3032; B30B 9/3078; B30B 9/3014; B30B 13/00; Y10S 100/902; Y10S 100/906; C22B 1/248; B21J 5/08; B21J 5/10
USPC ... 100/35, 42, 94, 98 R, 237, 232, 207, 209; 75/770; 72/362, 370.27, 333; 29/403.2
See application file for complete search history.

(56) References Cited

U.S. PATENT DOCUMENTS 3,129,656 A * 4/1964 Judd ..... B23D 31/008 100/232
3,141,401 A * 7/1964 Lindemann ..... B23D 31/008 100/215
3,577,912 A * 5/1971 Busi ..... B30B 9/328 100/218
3,791,289 A * 2/1974 Lamorte ..... B30B 9/3007 100/179

(Continued)

FOREIGN PATENT DOCUMENTS

KR 1134916 4/2013

*Primary Examiner* — Jimmy T Nguyen
(74) *Attorney, Agent, or Firm* — KramerAmado P.C.

(57) ABSTRACT

A double-acting apparatus and method for manufacturing metal scrap compression materials, in which a variety of shapes of collected metal scrap are compressed into pieces having a standardized shape such that they can be directly loaded into a blast furnace, thereby enhancing productivity. Two compression chambers are disposed at both sides of a first compression cylinder such that metal scrap is loaded into the compression chambers. In particular, when one of first press plates moves forward inside a first compression space of one of the compression chambers, the other one of the first press plates moves backward and returns to an idle position.

3 Claims, 17 Drawing Sheets

(56) References Cited

U.S. PATENT DOCUMENTS 9,321,232 B2 * 4/2016 Lee ..... B30B 9/3014

* cited by examiner

PRIOR ART

PRIOR ART

PRIOR ART

FIG. 11

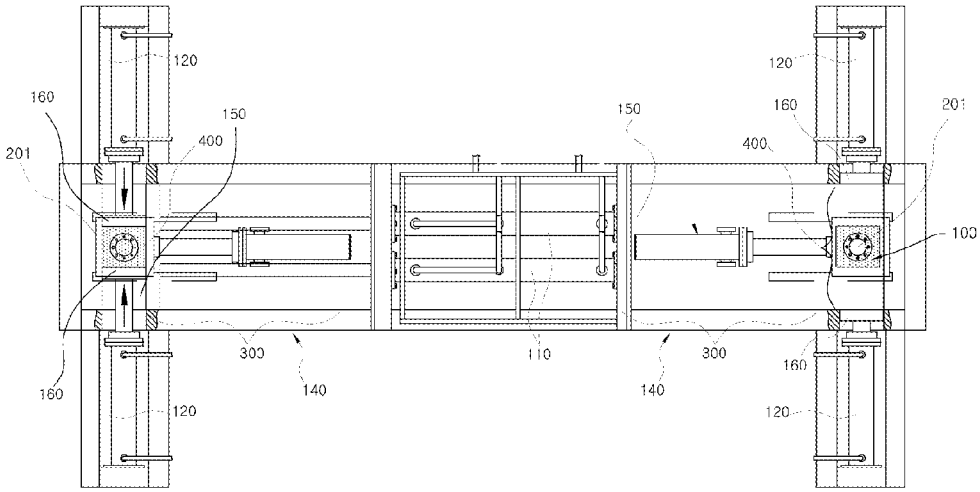

FIG. 12

Comparison table of process times (seconds)

| Item | | Lift up core | | Load scrap | | Close cover | |
|---|---|---|---|---|---|---|---|
| Conventional process time | | 10 sec | | 20 sec | | 13 sec | |
| Inventive process | Both | R | L | R | L | R | L |
| | Item | Lift up core | 2nd compression | Load scrap | Return 1st/2nd press plates | Close cover | Move down core |
| | Required time | 10 sec | 22 sec | 20 sec | 24 sec | 10 sec | 5 sec |
| | | 22 sec | | 24 sec | | 10 sec | |

| 1st compression | | 2nd compression | | Return 1st/2nd press plate | |
|---|---|---|---|---|---|
| 34 sec | | 22 sec | | 24 sec (15 sec) | |
| R | L | R | L | R | L |
| 1st compression | Open cover | 2nd compression | Discharge compression material | Return 1st/2nd press plate | Lift up core |
| 34 sec | 13 sec | 22 sec | 19 sec | 24 sec | 10 sec |
| 34 sec | | 22 sec | | 24 sec | |

| Move down core | | Open cover | | Discharge compression material | | total |
|---|---|---|---|---|---|---|
| 5 sec | | 13 sec | | 19 sec | | 160 sec |
| R | L | R | L | R | L | |
| Move down core | Load scrap | Open cover | Close cover | Discharge compression material | 1st compression | |
| 5 sec | 20 sec | 13 sec | 13 sec | 19 sec | 34 sec | 203 sec |
| 20 sec | | 13 sec | | 34 sec | | |

FIG. 19

Comparison table of process times (seconds)

| Item | | Lift up core | | Load scrap | | Close cover | |
|---|---|---|---|---|---|---|---|
| Conventional process time | | 10 sec | | 20 sec | | 13 sec | |
| Inventive process | Both | R | L | R | L | R | L |
| | Item | Lift up core | suspension | Load scrap | suspension | Close cover | suspension |
| | Required time | 10 sec | | 20 sec | | 10 sec | |
| | | 10 sec | | 20 sec | | 10 sec | |

| 1st compression | | 2nd compression | |
|---|---|---|---|
| 34 sec | | 22 sec | |
| R | L | R | L |
| 1st compression | Return 1st/2nd press plate, Move down core | 2nd compression | Open cover, Discharge compression material |
| 20 sec | 15 + 5 sec | 22 sec | 13 + 19 sec |
| 20 sec | | 32 sec | |

| Return 1st/2nd press plate | | Move down core | | Open cover | |
|---|---|---|---|---|---|
| 24 sec (15 sec) | | 5 sec | | 13 sec | |
| R | L | R | L | R | L |
| suspension | Lift up core | suspension | Load scrap | suspension | Close cover |
| | 10 sec | | 20 sec | | 13 sec |
| 10 sec | | 20 sec | | 13 sec | |

| Discharge compression material | | total | | |
|---|---|---|---|---|
| 19 sec | | 160 sec | | |
| R | L | R | L | 182 sec |
| Return 1st/2nd press plate, Move down core | 1st compression | Open cover, Discharge compression material | 2nd compression | |
| 15 sec | 20 sec | 13 + 19 sec | 22 sec | |
| 15 sec | | 32 sec | | |

FIG. 24

Comparison table of process times (seconds)

| Item | | Lift up core | | Load scrap | | Close cover | |
|---|---|---|---|---|---|---|---|
| Conventional process time | | 10 sec | | 20 sec | | 13 sec | |
| Inventive process | Both | R | L | R | L | R | L |
| | Item | Lift up core | suspension | Load scrap | suspension | Close cover | suspension |
| | Required time | 10 sec | | 20 sec | | 5 sec | |
| | | 10 sec | | 20 sec | | 5 sec | |

| 1st compression | | 2nd compression | |
|---|---|---|---|
| 34 sec | | 22 sec | |
| R | L | R | L |
| 1st compression | Return 1st/2nd press plate, Move down core | 2nd compression | Open cover, Discharge compression material |
| 20 sec | 15 + 5 sec | 22 sec | 5 + 19 sec |
| 20 sec | | 24 sec | |

| Return 1st/2nd press plate | | Move down core | | Open cover | |
|---|---|---|---|---|---|
| 24 (15) sec | | 5 sec | | 13 sec | |
| R | L | R | L | R | L |
| suspension | Lift up core | suspension | Load scrap | suspension | Close cover |
| | 10 sec | | 20 sec | | 5 sec |
| 10 sec | | 20 sec | | 5 sec | |

| Discharge compression material | | total | | |
|---|---|---|---|---|
| 19 sec | | 160 sec | | |
| R | L | R | L | 158 sec |
| Return 1st/2nd press plate, Move down core | 1st compression | Open cover, Discharge compression material | 2nd compression | |
| 15 sec | 20 sec | 5 + 19 sec | 22 sec | |
| 20 sec | | 24 sec | | |

DOUBLE-ACTING APPARATUS AND METHOD FOR MANUFACTURING METAL SCRAP COMPRESSION MATERIALS

TECHNICAL FIELD

The present invention relates to a double-acting apparatus and method for manufacturing metal scrap compression materials, and more particularly, to a double-acting apparatus and method for manufacturing metal scrap compression materials, in which a variety of shapes of collected metal scrap are compressed into pieces having a standardized shape such that they can be directly loaded into a blast furnace, thereby enhancing productivity.

BACKGROUND ART

The inventor of the present invention proposed an apparatus and method for manufacturing metal scrap compression materials as disclosed in Korean Patent No. 10-1134916 issued Apr. 17, 2012, entitled "Metal Scrap Compression Material and Manufacturing Apparatus and Manufacturing Method thereof" to Lee Tae Ho (hereinafter, referred to as "the cited reference"), in which the compression materials can be efficiently melted and the inner layer thereof can be observed.

The cited reference relates to metal scrap compression materials having at least one through-hole and an apparatus and method for manufacturing such metal scrap compression materials. The scrap compression materials are manufactured using a metal scrap compression apparatus, as shown in FIG. 1 to FIG. 3. The metal scrap compression apparatus includes a well-known metal scrap compression arrangement which includes a first compression cylinder 110 disposed at one side of a compression chamber, a first press plate 150 which is moved by a piston thereof inside a first compression space 300, second compression cylinders 110 disposed at both sides of the compression chamber, second press plates 160 which are moved by pistons thereof inside a second compression space 400, a discharge plate 502 positioned at the center of a second compression space 400, and means for opening and closing the discharge plate 502. In addition, in the metal scrap compression apparatus, at least one core 201 is erected at the center of the second compression space 140 such that it is orthogonal to first and second compression directions of the compression chamber 140. The core 201 is also caused to protrude and retract by a core cylinder 200 which is additionally disposed.

Since metal scrap compression materials which are manufactured by the cited reference as above have at least one through-hole, when these metal scrap compression materials are loaded into a melting furnace, molten metal not only contacts the circumference of the metal scrap compression materials but also permeates into the central portions of the metal scrap compression materials through the through-holes. Consequently, the metal scrap compression materials can be melted at a fast rate like small pieces of metal scrap compression materials, thereby greatly reducing the amount of energy that is consumed in the manufacture of metal products.

In addition, according to the manufacturing apparatus of the cited reference, when forming the through-hole in the metal scrap compression material, the metal scrap around the core 201 is first compressed in the first low-density compression process of compressing the metal scrap, and the compression of the metal scrap is completed in the second high-density compression process of compressing the metal scrap. It is therefore possible to minimize friction and stress that are applied to the core 201 from the metal scrap during the compression process.

In particular, in the cited reference, the length of the core 201 that is exposed inside the compression chamber in order to form the through-hole in the metal scrap compression material is set to the length of the actual through-hole of the metal scrap compression material. In the first and second compression processes, bending stress due to a variation in the density of the metal scrap is minimized. Furthermore, since the core itself is short, deformation is minimized, thereby significantly improving endurance. Accordingly, the apparatus can operate reliably and its longevity is increased.

Furthermore, in the cited reference, the first and second compression processes are carried out after the metal scrap has been loaded in the state in which the core is erected in the compression chamber. It is therefore possible to prevent the metal scrap from being caught between the core 201 and the cover 601 and between the core 201 and the bottom of the compression chamber 140, which would otherwise obstruct the operation, irrespective of the shape or type of the metal scrap. Accordingly, the apparatus can smoothly and reliably operate.

As mentioned above, the cited reference is configured such that the metal scrap is compressed twice in the first and second compression processes while surrounding the core 201, and the length of the core that corresponds to the length of the actual through-hole is exposed, unlike in a traditional metal scrap compressing apparatus. Therefore, the apparatus of the cited reference exhibits advanced properties, such as high strength and toughness, little bending or deformation, irrespective of high-pressure friction being applied to the metal scrap, increased longevity and a minimized possibility of breakdown. According to the cited reference, however, a minimum amount of time (e.g. 160 seconds) is required for the entire process of manufacturing one compression material from the metal scrap. The manufacturing process includes loading the metal scrap for first and second compression processes, starting the first compression using the first compression plate 150 by actuating the first compression cylinder 110, starting the second compression using the second compression plates 160 after the first compression is complete, and discharging the compression material after the second compression is complete. However, in this manufacturing process, it is difficult to further decrease the overall process time, thereby productivity cannot be increased, which is problematic.

Although a method for fabricating, constructing and using two or more apparatuses for manufacturing metal scrap compression materials can be considered, this requires an enormous manufacturing cost and the area required to accommodate the facilities is doubled. In addition, a labor cost is inevitably doubled in order to operate the two individual apparatuses. Therefore, the introduction of a more efficient apparatus for manufacturing metal scrap compression materials is required.

DISCLOSURE

Technical Problem

Accordingly, the present invention has been made keeping in mind the above problems occurring in the related art, and is intended to provide a double-acting apparatus and method for manufacturing metal scrap compression materials, in which one apparatus for manufacturing metal scrap compression materials can exhibit a high level of productivity that is similar to a level of productivity that would be obtained by operating two apparatuses for manufacturing metal scrap compression materials.

Technical Solution

In an aspect for realizing the foregoing object, the present invention provides a double-acting apparatus and method for manufacturing metal scrap compression materials, in which two compression chambers are disposed at both sides of a first compression cylinder such that metal scrap is loaded into the compression chambers. In particular, when one of first press plates moves forward inside a first compression space of one of the compression chambers, the other one of the first press plates moves backward and returns to an idle position.

The upper portions of the compression chambers are opened or closed by cover cylinders. A compression material is manufactured using second press plates which slide by power from second compression cylinders at both sides of second compression spaces of the two compression chambers, and is discharged to the outside.

The direction in which compression is carried out by the first press plates disposed in the two compression chambers is orthogonal to the direction in which compression is carried out by the second press plates in the two compression chambers. One core is disposed in each of the two compression chambers. The core is erected at each center of the second compression chambers such that it is orthogonal to each of the direction in which the first press plate is compressed and the direction in which the second press plates is compressed.

One core cylinder is disposed in each of the two compression chambers in order to lift up the core, and is disposed on the bottom such that the core can be retracted to a level that is at or below the bottom plate of the compression chamber or the upper end of the core can be protruded to a height at which it adjoins the undersurface of a cover.

Advantageous Effects

According to the present invention as described above, it is possible to sequentially compress metal scrap which is loaded into two compression chambers using only one first compression cylinder which occupies a large area due to its large volume. It is therefore possible to carry out the process of compressing the metal scrap in one compression chamber while carrying out the process of discharging a compression material, the compression of which has been completed, from the other compression chamber and loading new metal scrap into the other compression chamber.

Accordingly, there are the following effects: Even though the overall fixed time is somewhat increased, the time required for the manufacture of each material is significantly decreased since compression materials are continuously manufactured. Also, it is more possible to decrease a labor cost than in the case in which the two apparatuses are fabricated and constructed. Since only the construction of one first compression cylinder is required, it is possible to reduce power consumption of, for example, a hydraulic motor.

DESCRIPTION OF DRAWINGS

FIG. 7 to FIG. 11 are top plan views of the double-acting apparatus for manufacturing metal scrap compression materials according to the present invention;

FIG. 12 is a table comparing times required for the apparatus for manufacturing metal scrap compression materials according to the present invention and for the apparatus of the cited reference times spent when carrying out their processes;

FIG. 19 is a table comparing times required for the apparatus for manufacturing metal scrap compression materials according to another embodiment of the present invention and for the apparatus of the cited reference times spent when carrying out their processes;

FIG. 24 is a table comparing times required for the apparatus for manufacturing metal scrap compression materials according to the present invention shown in FIG. 20 and for the apparatus of the cited reference times spent when carrying out their processes.

MAJOR REFERENCE NUMERALS AND SYMBOLS OF THE DRAWINGS

Figure 1:
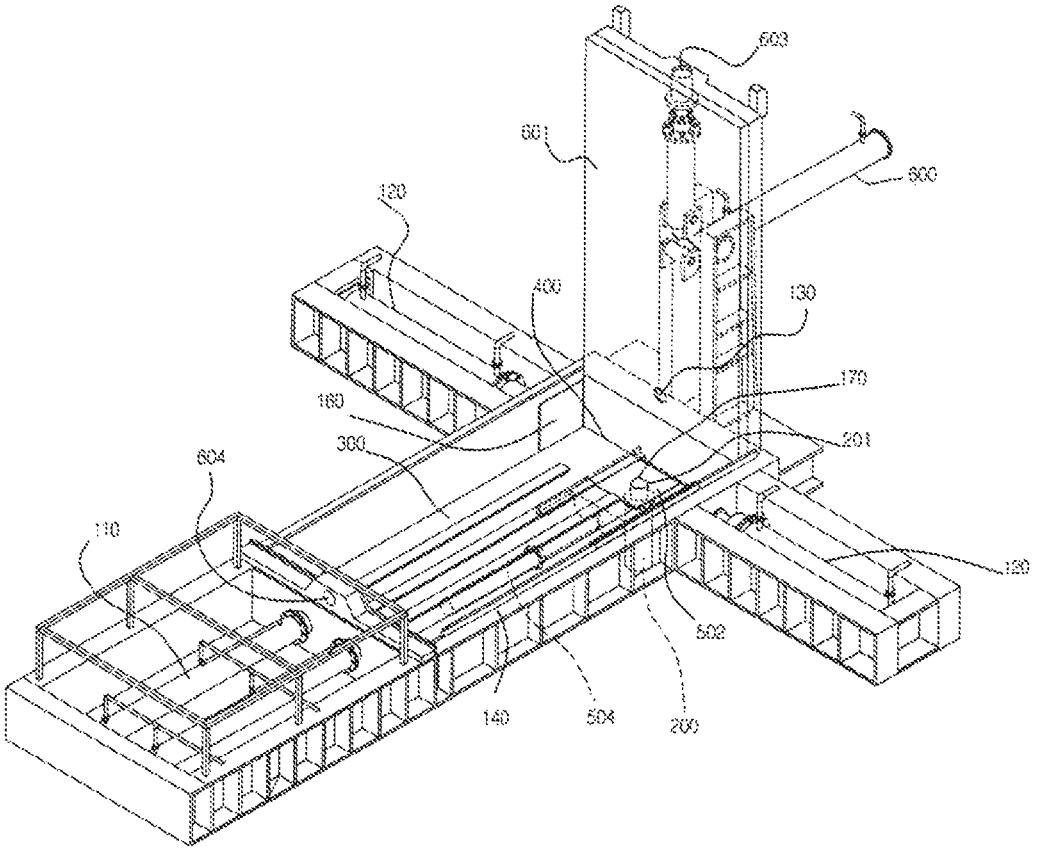
FIG. 1 a perspective view showing the overall configuration of a cited reference.
Figure 2:
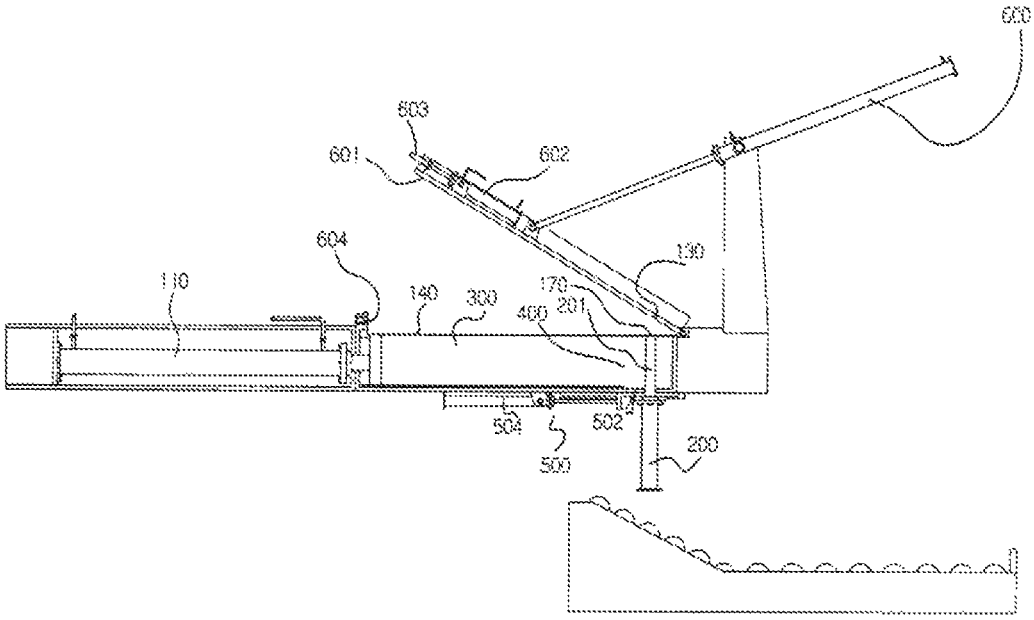
FIG. 2 is a side-elevation view showing the state in which a cover is opened in the cited reference.
Figure 3:
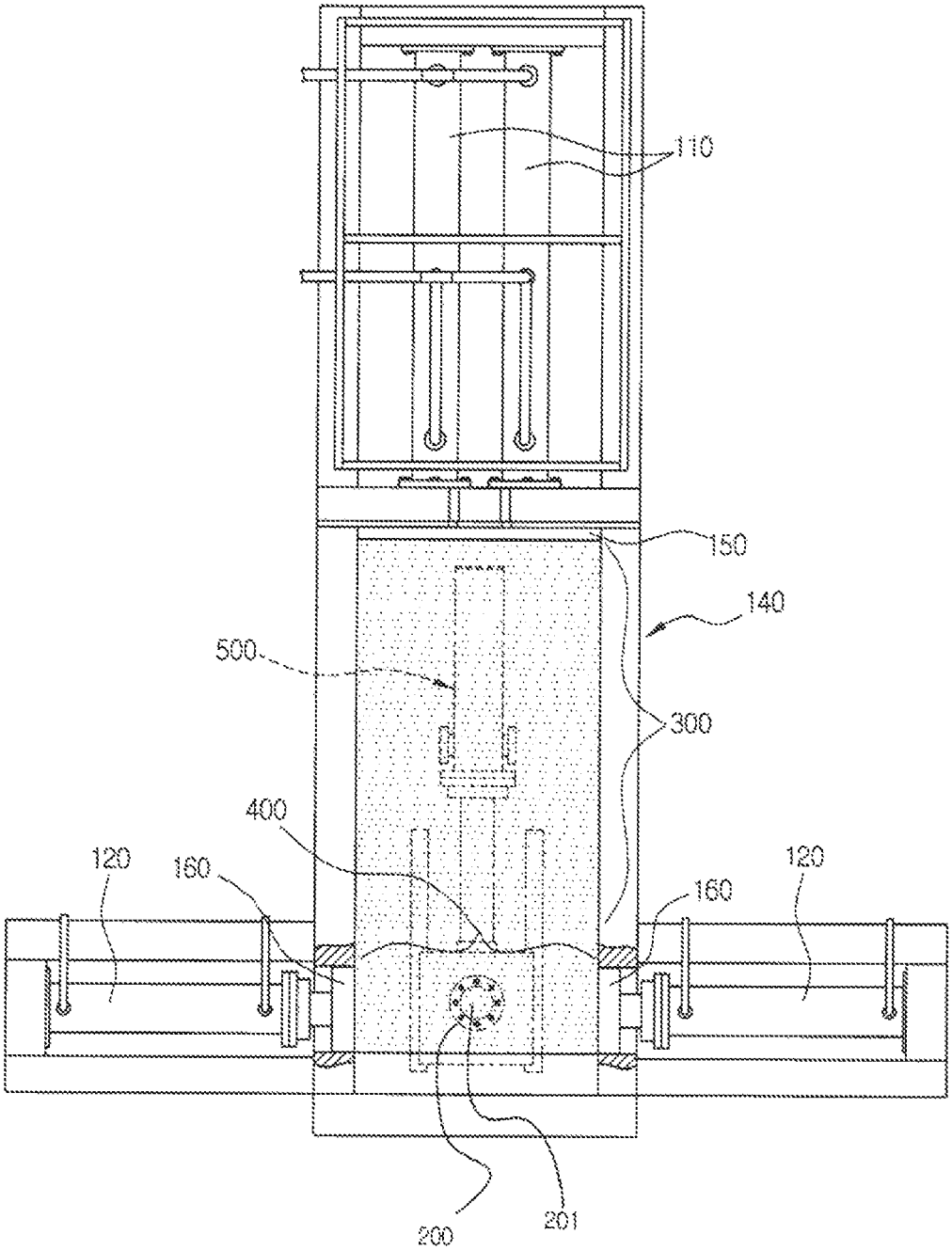
FIG. 3 is a top plan view showing the state in which loading of scraps has been completed.

100: compression material
110: first compression cylinder
120: second compression cylinder
140: compression chamber
150: first press plate
160: second press plate
200: core cylinder
201: core
300: first compression space
400: second compression space
501: discharge hole

502: discharge plate
504: hydraulic cylinder
600: cover cylinder
601: cover
602: locking cylinder
603: locking hole
604: hinge shaft

BEST MODE

A double-acting apparatus for manufacturing metal scrap compression materials includes: a core which is vertically erected in the central portion of a compression chamber, and a first press plate which is to be actuated by a first compression cylinder, and a second press plate which is to be actuated by a second compression cylinder, the second press plate being disposed so as to orthogonally intersect the first press plate. First compression cylinders and first press plates are additionally disposed at both left and right end sides of the compression chamber about the first cylinder, and each length of the first compression cylinders which are disposed at both left and right end sides of the compression chamber is half of the length of the first compression cylinder which is disposed at the center.

Mode for Invention

Figure 4:
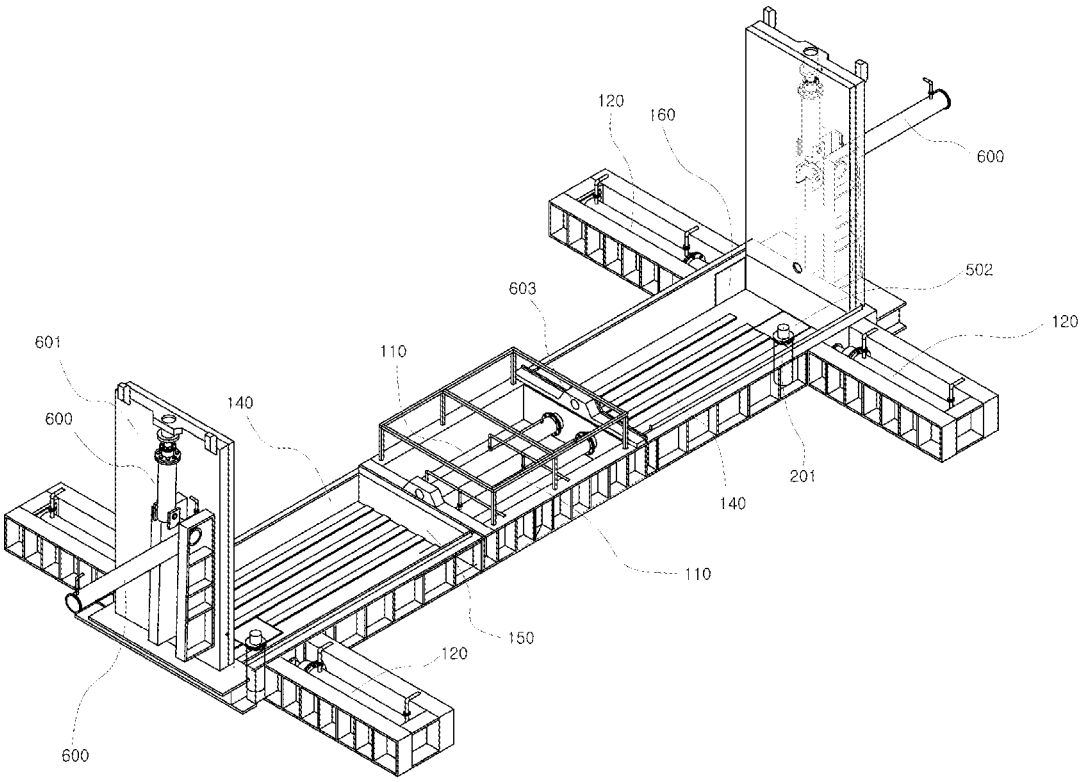
FIG. 4 is a perspective view showing a double-acting apparatus for manufacturing metal scrap compression materials according to the present invention.
Figure 5:
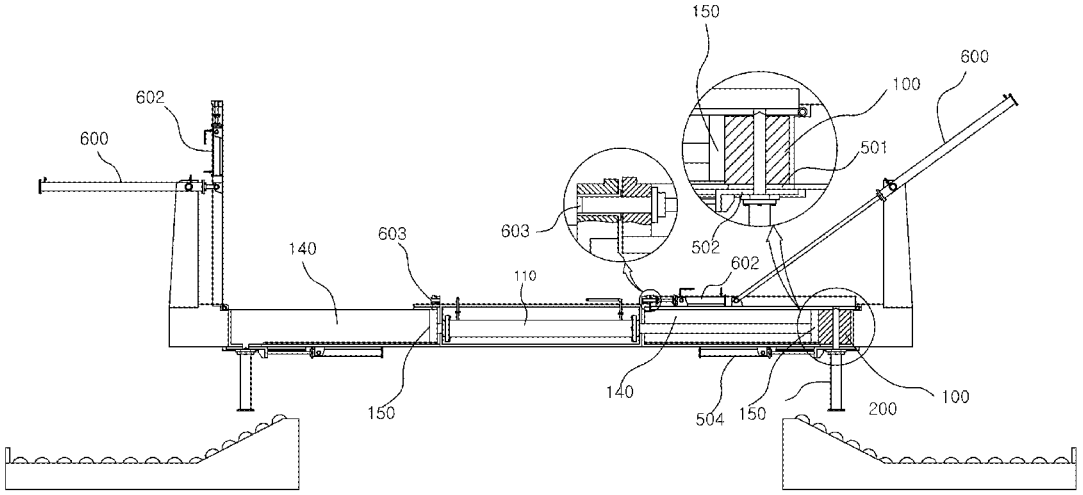
FIG. 5 is a side elevation view of the double-acting apparatus for manufacturing metal scrap compression materials according to the present invention.
Figure 6:
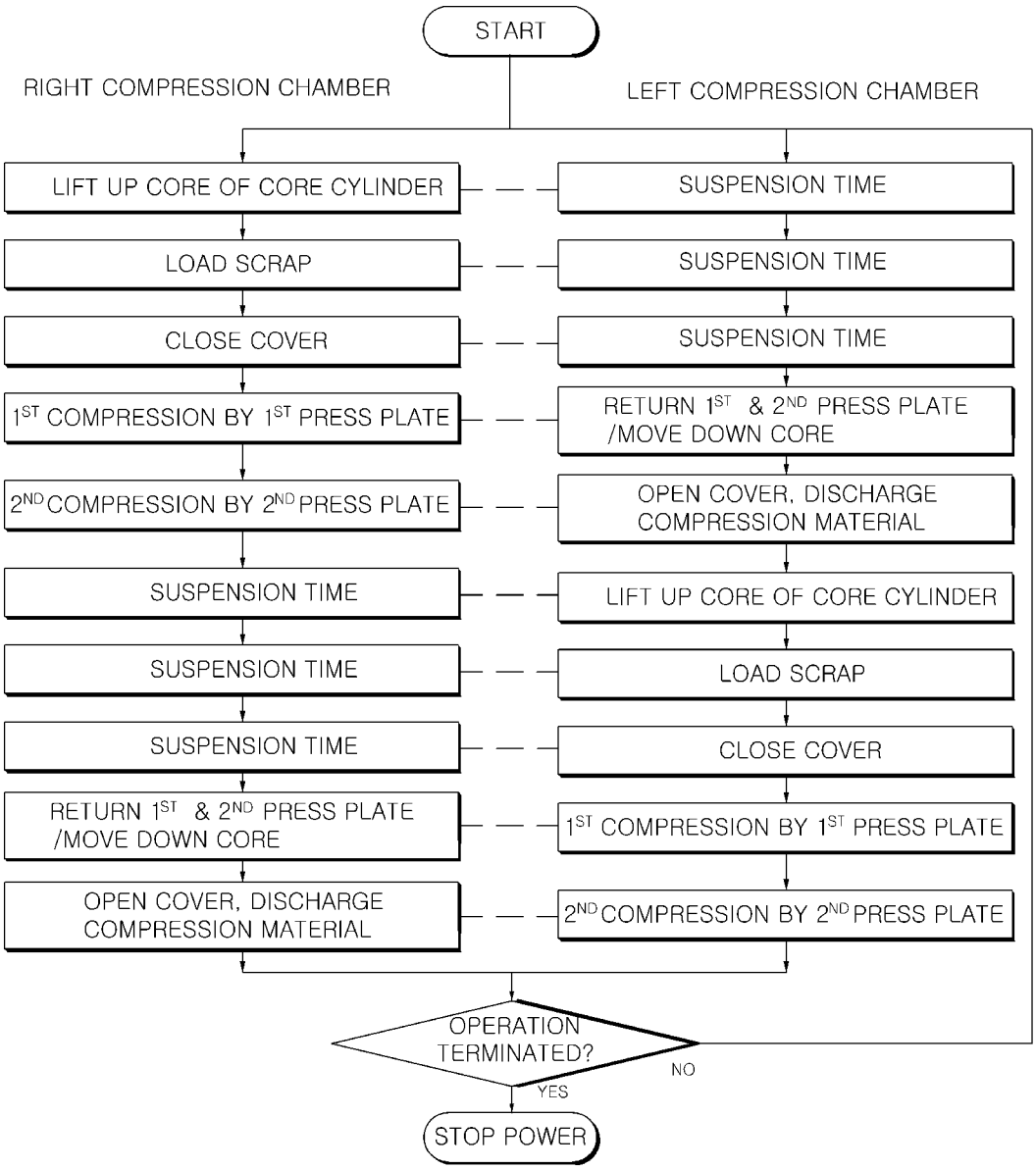
FIG. 6 is a flowchart showing a double-acting method for manufacturing metal scrap compression materials according to the present invention.

In order to illustrate the detailed operation of the double-acting apparatus for manufacturing metal scrap compression materials according to the present invention, the overall configuration of the manufacturing apparatus is shown in a perspective view of FIG. 4 and a side elevation view of FIG. 5. In addition, the overall operation of the manufacturing apparatus is shown in a flowchart of FIG. 6. As shown in these figures, according to the present invention, two compression chambers 140 are fixedly disposed at both sides of a first compression cylinder 110 such that metal scrap is loaded into the compression chambers 140. First press plates 150 are fixed to both ends of each piston such that they slide inside the compression chambers 140. In particular, when one of the first press plates 150 moves forward inside a first compression space 300 of one of the compression chambers 140, the other one of the first press plates 150 moves backward inside a first compression space 300 of the other one of the compression chambers 140.

The upper portions of the compression chambers 140 are opened or closed by cover cylinders 600. A compression material 100 is compressed by second press plates 160 which slide by power from second compression cylinders 120 at both sides of second compression spaces 400 of the two compression chambers 140, and is discharged through a discharge hole 501.

The direction in which compression is carried out by the first press plates 150 disposed in the two compression chambers 140 is orthogonal to the direction in which compression is carried out by the second press plates 160 in the two compression chambers 140. One core 201 is disposed in each of the two compression chambers 140. The core 201 is erected at each center of the second compression chambers 400 such that it is orthogonal to each of the direction in which the first press plate 150 is compressed and the direction in which the second press plates 160 is compressed.

One core cylinder 200 is disposed in each of the two compression chambers 140 in order to lift up the core 201, and is disposed on the undersurface of a discharge plate 502 such that the core 201 can be retracted to a level that is at or below the height of the discharge plate 502 or be protruded to a height at which it adjoins the undersurface of a cover 601.

The present invention having the above-described configuration differs from the cited reference in which one first press plate 150 is fixed to the first compression cylinder 110 so as to slide. Rather, each of the first compression cylinders 110 of the present invention is manufactured such that the pistons thereof protrude in opposite directions. In particular, both ends of each piston protrude into the two compression chambers 140, and each end of the piston is fixed to the corresponding first press plate 150.

Therefore, the two first press plates 150 carry out the conflicting operations in the compression chambers 140 in response to actuation of the first compression cylinders 110. Consequently, when a compression process is being carried out in the state in which the cover 601 is closed after scrap has been loaded into one compression chamber 140, the first and second press plates 150 and 160 return and the core 201 moves down in the other compression chambers 140. After the cover 601 is opened and the compression material 100 is discharged, new metal scrap can be loaded. Accordingly, one worker can manage and operate the double-acting apparatus for manufacturing metal scrap compression materials.

A detailed description will be given below of the process that is concurrently carried out in the two compression chambers 140 according to the present invention.

Figure 7:
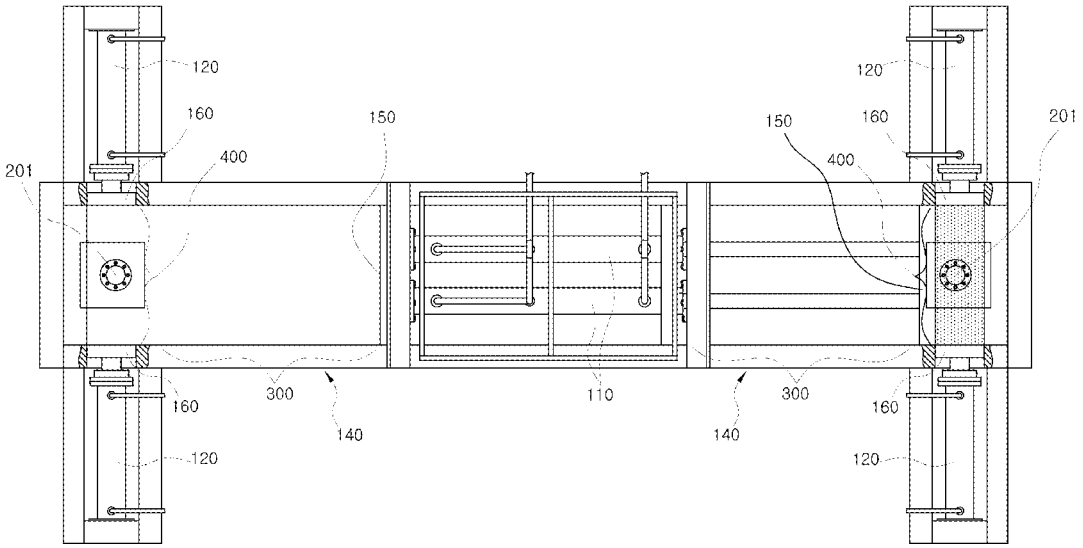

First, the basic process according to the present invention is shown in FIG. 7 to FIG. 11. First, as shown in FIG. 7, reference is given to the compression chambers 140 disposed at both sides of the first compression cylinders 110. In the left compression chamber 140 in the figure, the first and second press plates 150 and 160 have returned such that the first press plate 150 of the first compression cylinder 110 is pressed to the right in the figure and the second press plates 160 have returned to the idle position. The cover 601 in the left part of the figure is moved down by the cover cylinder 600 such that it covers the compression chamber 140. However, the cover 601 is not shown. The core 201 is moved down by the core cylinder 200.

In the meantime, the compression chamber 140 in the right part of the figure is covered with the cover 601. However, the cover 601 is not shown in order to illustrate the inside of the compression chamber 140, which is marked with solid lines. At present, the first press plate 150 of the first compression cylinder 110 has advanced to the end toward the core 201, thereby completing first compression. The second press plates 160 of the second compression cylinders 120 at both sides of the first press plate 150 are waiting to be operated.

In this state, the cover 601 in the left part of the figure is erected and opened by the cover cylinder 600, so that any compression material that has been completely compressed is discharged in a continuous process. However, there is no compression material that has been completely compressed because this is the initial state. Illustrations of the cover cylinders 600 or the like are omitted for the sake of convenience.

Figure 8:
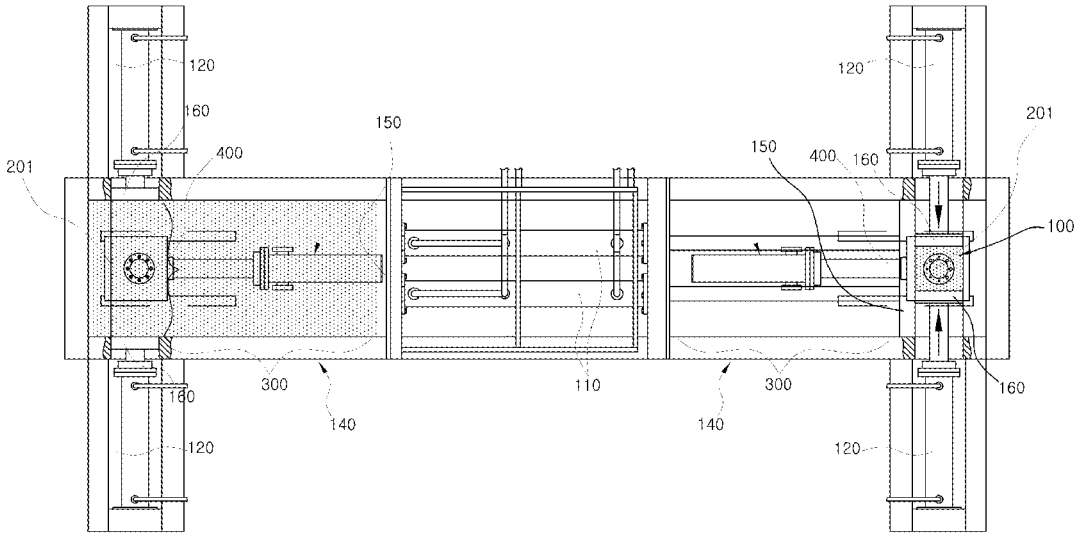

In this state, as shown in FIG. 8, in the right part of the figure, second compression is carried out by the second press plates 160 using the second compression cylinders 120.

After the second compression has been carried out, during a suspension time, the operations of lifting up the core 201, loading new scrap, and closing the cover 601 are carried out in response to actuation of the core cylinder 200.

Figure 9:
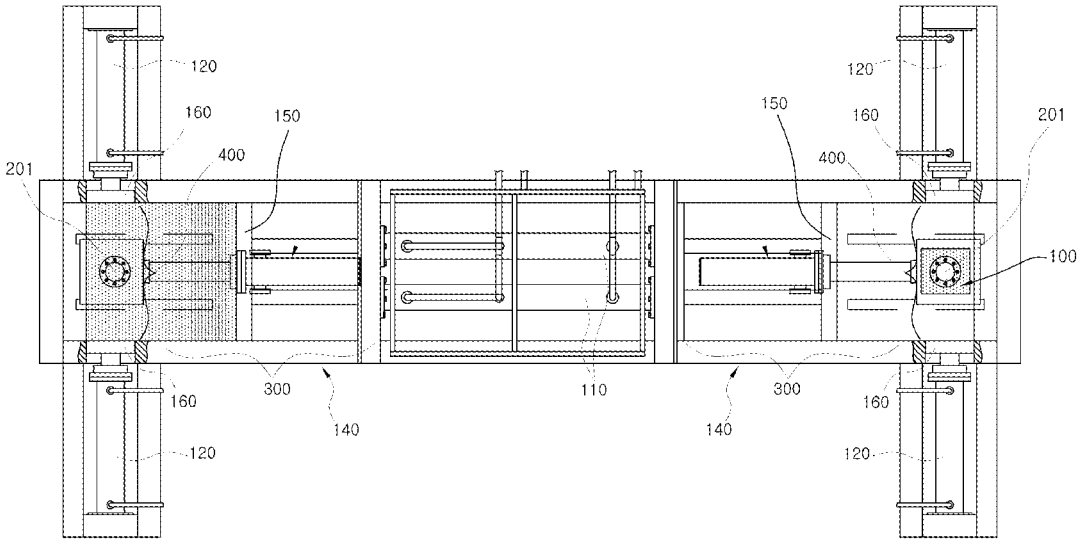

Afterwards, first compression is carried out in the compression chamber 140 in the left part of the figure, and the first and second press plates 150 and 160 are retracted in response to actuation of the first and second compression cylinders 110 and 120, the state of which is shown in FIG. 9.

Figure 10:
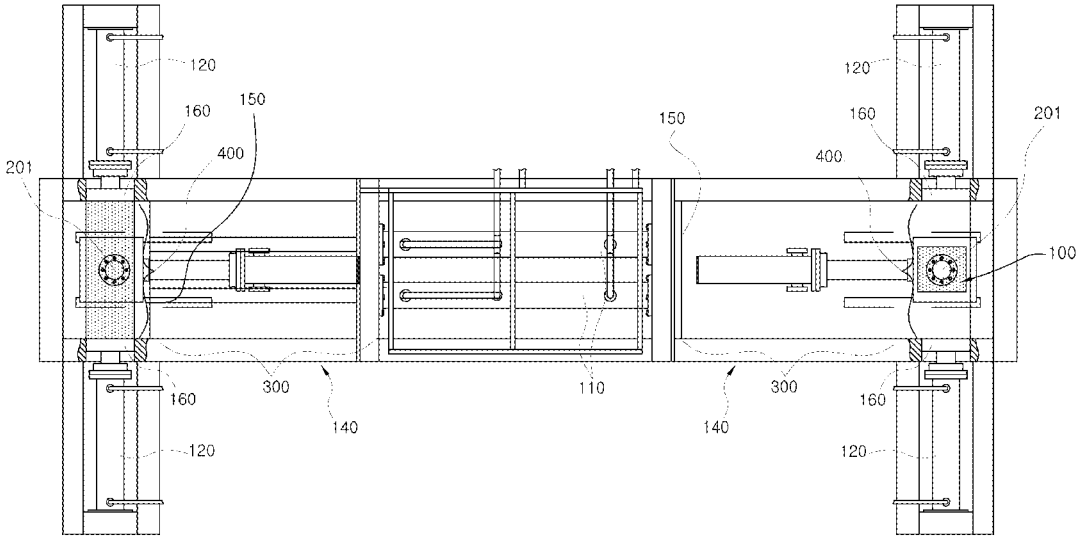

When this state is maintained, in the compression chamber in the left part of the figure, the compression using the first press plate 150 is completed. In the compression chamber in the right part of the figure, the first and second press plates completely return to the idle positions, and the core 201 is moved down in response to actuation of the core cylinder In sequence, as shown in FIG. 10, the compression chamber 140 in the left part of the figure is in the idle position, in which second compression using the second press plates 160 is to be carried out. In this state, the compression chamber 140 in the right part of the figure waits for the operation of opening the cover 601 using the cover cylinder 600.

In the subsequent operation, as shown in FIG. 11, the second compression is completed in the compression chamber 140 in the left part of the figure. In the compression chamber 140 in the right part of the figure, the operation of opening the cover 601 is carried out and the compression material that has been completely compressed can be discharged.

In sequence, the present invention determines whether or not an operation stop button for stopping a typical power supply which is not shown is pressed. When the operation stop button is pressed, the supply of power is stopped, and all operations are stopped.

When the operation stop button is not pressed, the compression chamber 140 in the left part of the figure instantly proceeds to a suspension time. In the compression chamber in the right part of the figure, the operations of lifting up the core 201 using the core cylinder 200, loading scrap, and closing the cover 601 using the cover cylinder are carried out. Afterwards, first compression is carried out using the first press plate 150. In the left part of the figure, the first and second press plates 150 and 160 return to the idle positions, and the core 201 is moved down, as shown in FIG. 7. Accordingly, it is possible to repeatedly manufacture metal scrap compression materials by repeating the above-described processes.

In addition, an embodiment of the present invention is also shown, wherein the embodiment includes the discharge holes 501 through which the compression material 100 is discharged to the bottom of the two compression chambers 140 in order to take out the compression material 100 after the compression thereof has been completed, the discharge plates 502 which close or open the discharge holes 501, and hydraulic cylinders 504 which slide the discharge plates 502. The hydraulic cylinders 504 serve to slide the discharge plates 502 to which the core cylinders 200 are fixed. According to this embodiment, the cores 201 are moved down in response to actuation of the core cylinders 200, and the discharge plates 502 and the core cylinders 200 are moved in response to actuation of the hydraulic cylinders 504. The metal scrap compression materials 100 can drop through the discharge holes 501 and be discharged to the outside as being moved on a conveyor that is positioned below. In sequence, the hydraulic cylinders 504 are actuated again in order to return the discharge plates 502 and the core cylinders 200 to the original positions.

In addition to this embodiment, it may be difficult to construct and operate facilities precisely because of poor or undesirable site conditions. In such a case, it is possible to pick up and deliver the compression material using an excavator after a time point when the core 201 is moved down and released from the compression material, as will be described in Embodiments 1 and 2.

In addition, according to the present invention, in the compression chamber 140 in the left part of the figure, when the cover 601 is closed in response to actuation of the cover cylinder 600, the piston is fitted into a locking hole in the compression chamber 140, so that the cover 601 is firmly fixed while covering the compression chamber 140.

Since the present invention as described above is intended to sequentially compress the metal scrap loaded in two compression chambers 140 using one first compression cylinder 110, a suspension time is set in order to synchronize the processes in the two compression chamber 140. Accordingly, the continuous processes are smoothly carried out even though one first compression cylinder 110 is shared in the two compression chambers 140.

In this method according to the present invention, a number of essential processes that must be carried out in order to compress the metal scrap require different amounts of time. Accordingly, when concurrently carrying out the individual processes, certain times required for corresponding processes must be increased. This inevitably leads to a time delay in which, although one process has been completed at one side, it is required to wait for the completion of the corresponding process at the other side before starting the next process at the one side. For this, a suspension time must be set, which causes a considerable amount of overall time delay. However, it can be understood from the following embodiments that productivity per unit time is significantly improved since two compression materials 100 are manufactured.

This will be described in detail as follows with reference to appended FIG. 12 which shows a table of an embodiment.

Embodiment 1

In order to help understanding of an embodiment of the present invention, the process of manufacturing scrap compression materials 100 which are compressed to an intended density by compressing the metal scrap according to the cited reference is described as follows.

First, according to the cited reference, the locking cylinder 602 is actuated so that the piston thereof protrudes from the locking hole, the cover 601 is opened and erected in response to actuation of the cover cylinder 600, and then the core 201 is lifted up into the compression chamber 140 for about 10 seconds. In sequence, metal scrap is loaded into the compression chamber 140. This takes about 20 seconds in a case where the scrap has been prepared in advance. In sequence, the cover 601 is moved down in response to actuation of the cover cylinder 600, and the locking cylinder 602 is actuated so that the piston thereof is fitted into the locking hole formed in the compression chamber 140, thereby firmly closing the cover 601, which takes 13 seconds.

In sequence, the first compression is carried out using the first press plate 150 by actuating the first compression cylinder 110. A time of 34 seconds is required until the first press plate 150 moves to the end. In addition, 22 seconds are required to carry out the second compression using the second press plates 160 of the second compression cylinder 120. After the first compression and the second compression as above are completed, the first and second press plates 160 return to the idle positions in response to actuation of the first and second compression cylinders 110 and 120, which take 24 and 15 seconds.

In addition, 5 seconds are required to move down the core 201 in response to actuation of the core cylinder 200, and 13 seconds are required to erect and open the cover 601 in response to actuation of the cover cylinder 600 after the locking cylinder 602 is actuated so that the piston thereof protrudes from the locking hole. In sequence, the process of discharging the scrap compression material 100 out of the compression chamber 140 is repeated. 19 seconds are required to discharge the compression material using heavy equipment.

In the process of manufacturing scrap compression materials of the related art, the sequential processes must be continuously carried out. Since the processing steps require the absolute times, it is impossible to improve productivity by decreasing the time.

In the related art, as illustrated in FIG. 12, the individual processes require 10, 20, 13, 22, 24, 5, 13 and 19 seconds, and thus 160 seconds are required for the manufacture of one scrap compression material 100.

The present invention has been devised considering that it is difficult to reduce the whole process time when the fixed processes are sequentially carried out, and is configured such that the process of the cited reference is carried out in both the compression chambers 140 which are disposed at both sides of the first compression cylinder 110. Since the first press plates 150 disposed at both sides are disposed at opposite positions, different processes are carried out in the compression chambers 140. Accordingly, the process is carried out as shown in the lower part of the table of FIG. 12.

Specifically, according to this embodiment of the present invention, as shown in FIG. 7, the compression chamber 140 in the left part of the figure waits for a suspension time until 30 seconds are passed in the compression chamber 140 in the right part of the figure, including 10 seconds required to lift up the core 201, 20 seconds required to load the scrap and 10 seconds for closing the cover 601. In sequence, as shown in the right compression chamber 140 in FIG. 7, the first compression process of compressing the scrap using the first press plate is started. The compression proceeds for 34 seconds. During this time, the first and second press plates 150 and 160 in the left part of the figure complete returning to the idle positions for 24 seconds and 15 seconds. When the first compression in the right part is complete, the first and second press plates 150 and 160 in the left part completely return to the idle positions.

After such operations are completed, the second press plates 160 in the compression chamber 140 in the right part of the figure start second compression, which operation proceeds for 22 seconds.

In addition, the cover 601 in the compression chamber 140 in the left part of the figure completes the opening operation for 13 seconds. 19 seconds are required to discharge the compression material.

In the compression chamber 140 in the right part of the figure, second compression using the second compression cylinder 120 is carried out for 22 seconds.

In sequence, in the compression chamber 140 in the left part of the figure, about 10 seconds are required to lift up the core 201, 20 seconds are required for the process of loading the metal scrap into the compression chamber 140, and 13 seconds are required to actuate the cover cylinder 600 so that the cover 601 is moved down and then actuate the locking cylinder 602 so that the piston thereof is fitted into the locking hole in the compression chamber 140 so that the cover 601 is firmly closed. During this time, the right compression chamber 140 has a suspension time.

In sequence, the first press plate 150 which is disposed in the compression chamber 140 in the left part of the figure carries out the first compression process for 34 seconds, during which time the first and second press plates 150 and 160 in the right compression chamber 140 return to the idle positions within 24 seconds. In sequence, while the second compression on the metal compression material 100 is being carried out using the second press plates 160 in the left compression chamber 140, the cover is opened for 13 seconds and the compression material is discharged for 19 seconds in the right compression chamber 140. Afterwards, as described above, while the left compression chamber 140 is waiting, the above-described operations of lifting up the core 201, loading scrap, and closing the cover 601 are repeated. Accordingly, the compression can be continuously carried out by operating one compression cylinder 110 in the two compression chambers 140.

According to this embodiment, as indicated in FIG. 12, the times required for the processes in the two compression chambers 140 are 10, 20, 10, 34, 32, 10, 20, 13, 34 and 32 seconds. Therefore, 215 seconds are required, which are increased by about 45 seconds than the above-described process of the cited reference. This result shows an increase of 34.4% in terms of the process time. However, since the two compression materials 100 are manufactured, the process time for each compression material is decreased to 107.5 seconds from 160 seconds. This result indicates that 1.48 compression materials can be manufactured for 160 seconds, which are the time required for the manufacture of one compression material in the related art.

In addition, according to embodiment 1 of the present invention, only one first compression cylinder 110 which consumes a large amount of power is used. This can lead to the effect of saving electric power compared to the case in which two individual facilities for manufacturing scrap compression materials are fabricated, constructed and used. It is also possible to significantly reduce the manufacturing cost and significantly reduce the area of construction. Furthermore, since only one worker is required to operate the facilities, the present invention can contribute to a reduction in labor cost.

Furthermore, according to the present invention, as shown in FIG. 7 to FIG. 11, when the first press plate 150 of the first compression cylinder 110 presses the metal scrap in one direction in the compression chamber 140, the metal scrap passes through the core 201 that is erected. Since the core 201 has substantially no ductility, the final compression material 100 still has a hole that is formed behind the core 201 even when the second compression process is carried out. Frequently, this portion is not filled after the process is completed. This inevitably decreases the overall density of the metal scrap compression material 100. This problem can be overcome by an embodiment shown in FIG. 13 to FIG. 18. According to this embodiment, since the first press plate 150 of the first compression cylinder 110 moves to a short distance, the time required for the manufacture of one scrap compression material can be further decreased.

That is, according to this embodiment, both of two masses of metal scrap loaded around the cores 201 inside the compression chambers 140 are compressed using the first compression cylinders 110. Therefore, the length of the first compression cylinders 110 and the length of the pistons thereof can be decreased to be about half of those shown in FIG. 7 to FIG. 11. First compression cylinders 110 having a short length are additionally disposed outside the two compression chambers 140. Accordingly, the compression is carried out at the center of each compression chamber 140 using two first compression cylinders 110. This embodiment is shown as a side elevation view in FIG. 13.

Figure 13:
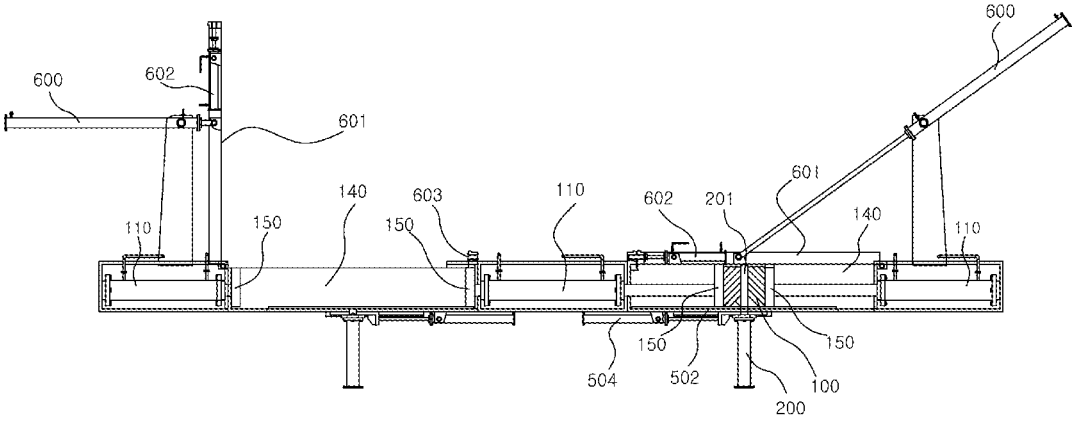
FIG. 13 is a side elevation view showing another embodiment of the present invention, in which first cylinders are disposed at the center between the two compression chambers and outside the two compression chambers.

In the right part of FIG. 13, the first press plates 150 are fixed to the first compression cylinder 110 which is disposed at the center and to the first compression cylinder 110 which is disposed at the right end of the compression chamber 140 such that they move about the core 201 to a distance that is about half of the traditional distance, thereby rapidly compressing the scrap toward the core 201 at the center. When moving to the idle positions, it takes about half of the traditional time. Therefore, the time required to move the first compression cylinders 110 to the compressing and idle positions is significantly decreased. This operation is the same as for the first compression cylinders 110 at both sides of the compression chamber 140 in the left part of FIG. 13. A detailed description will be given below of Embodiment 2 of the present invention that has this configuration.

Embodiment 2

Since the first press plates 150 disposed at both sides of the first compression cylinders 110 are disposed at opposite positions, processes are carried out as indicated in the lower part of the comparison table of FIG. 19 so that different processes are carried out.

Figure 14:
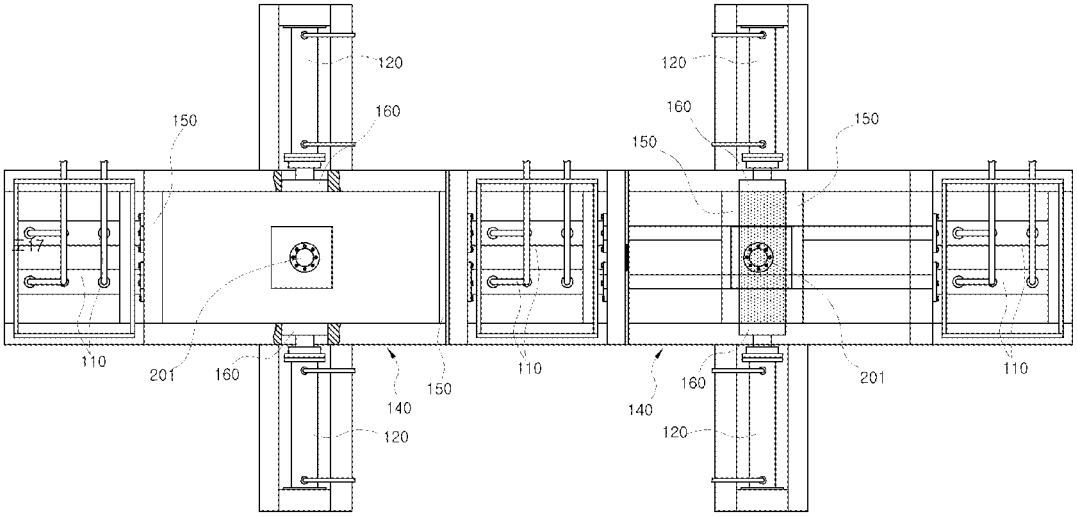
FIG. 14 to FIG. 18 are top plan views showing the operation of the double-acting apparatus for manufacturing metal scrap compression materials according to another embodiment of the present invention shown in FIG. 13.
Figure 15:
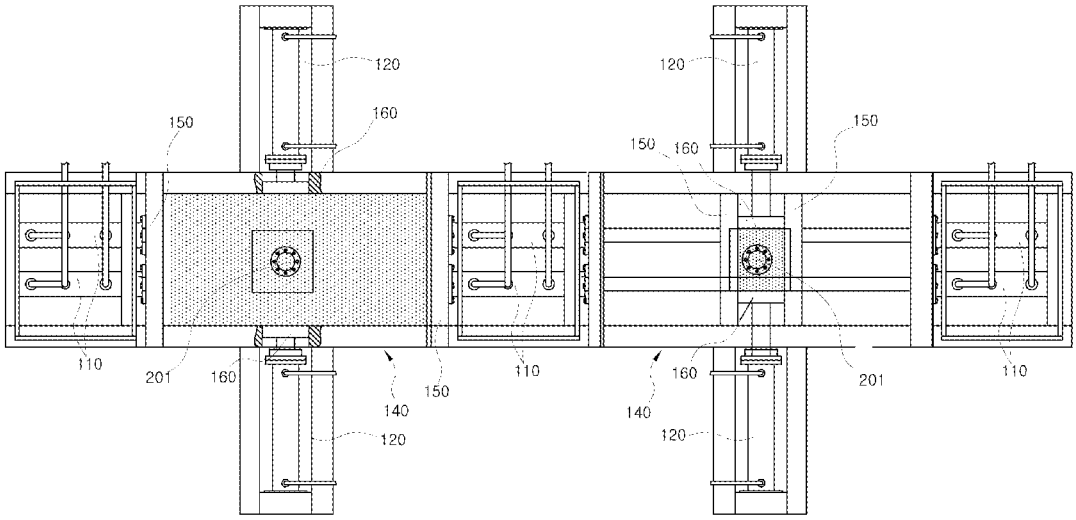
Figure 16:
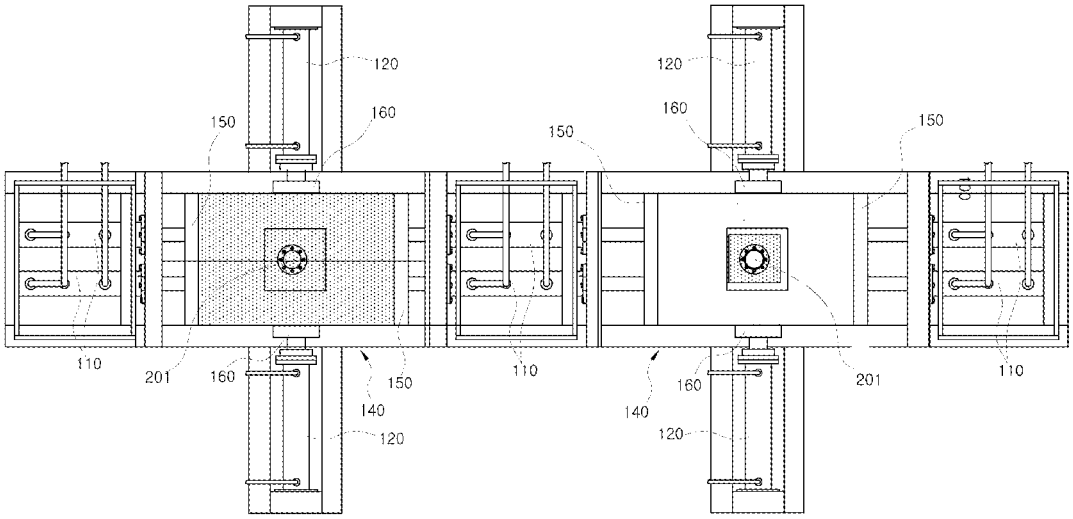
Figure 17:
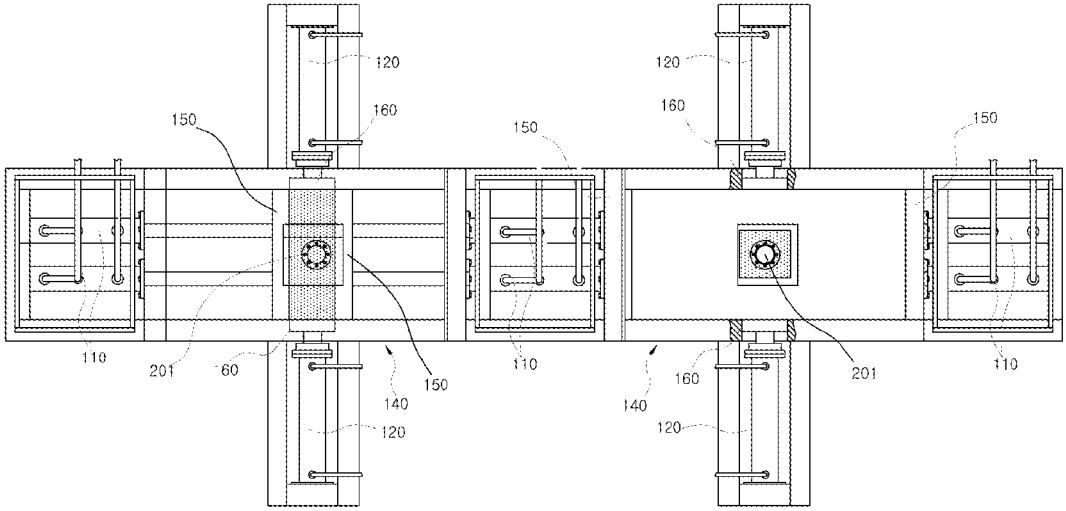
Figure 18:
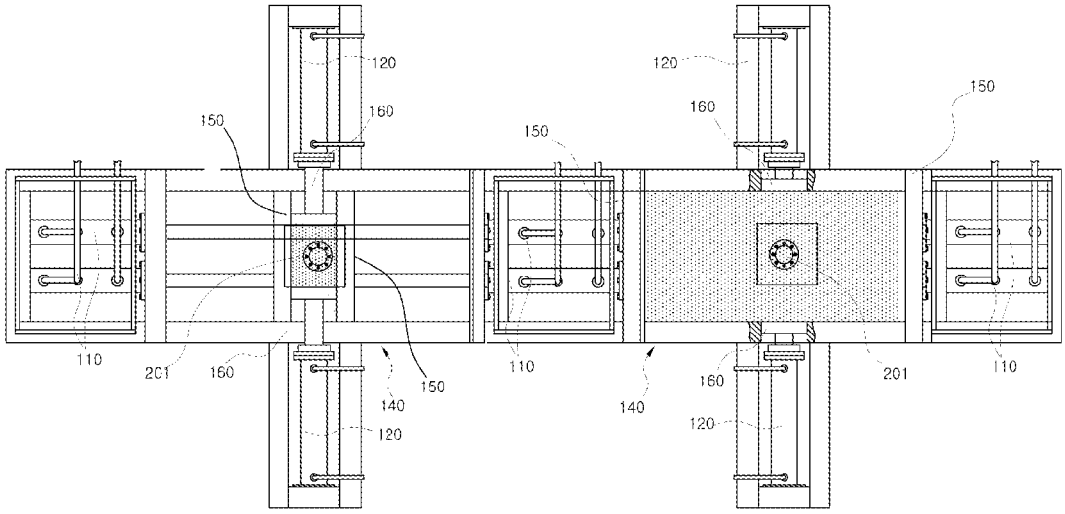

Specifically, according to this embodiment of the present invention, as shown in FIG. 14, the compression chamber 140 waits for a suspension time until 30 seconds have passed in the compression chamber 140 in the right part of the figure, including 10 seconds required to lift up the core 201, 20 seconds required to load the scrap and 10 seconds required to close the cover 601. In sequence, as shown in the right compression chamber 140 in FIG. 14, the first compression of compressing the scrap using the first press plates is started and proceeds for 20 seconds, which is about half of the time required in Embodiment 1. During this time, the first and second press plates 150 and 160 in the left part of the figure completely return to the idle positions for 20 seconds based on the first press plates which take a longer time. The core 201 is also operated to move down within 20 seconds.

After such operations are completed, the second press plates 160 in the compression chamber 140 in the right part of the figure start second compression, which proceeds for 22 seconds.

In addition, the cover 601 in the compression chamber 140 in the left part of the figure takes 13 seconds to complete the opening operation, and 19 seconds are required to discharge the compression material.

In sequence, in the compression chamber 140 in the left part of the figure, about 10 seconds are required to lift up the core 201, 20 seconds are required for the process of loading the metal scrap into the compression chamber 140, and 13 seconds are required to actuate the cover cylinder 600 so that the cover 601 is moved down and then actuate the locking cylinder 602 so that the piston thereof is fitted into the locking hole in the compression chamber 140 so that the cover 601 is firmly closed. During this time, the right compression chamber 140 has a suspension time.

In sequence, the first press plates 150 which are disposed in the compression chamber 140 in the left part of the figure carry out the first compression for 20 seconds, during which time the first and second press plates 150 and 160 in the right compression chamber 140 return to the idle positions within 15 seconds. In sequence, while the second compression on the metal compression material 100 is being carried out using the second press plates 160 in the left compression chamber 140, the cover is opened for 13 seconds and the compression material is discharged for 19 seconds in the right compression chamber 140. Afterwards, as described above, while the left compression chamber 140 is waiting, the above-described operations of lifting up the core 201, loading scrap, and closing the cover 601 are repeated. Accordingly, the compression processes can be continuously carried out by operating one compression cylinder 110 in the two compression chambers 140.

According to Embodiment 2 as described above, the time required for actuating the first press plates 150 using the first compression cylinders 110 so that the first press plates 150 perform compression and return to the original positions is about half of the time required for Embodiment 1. Therefore, as indicated in FIG. 19, the process time required for the two compression chambers 140 is 182 seconds, which is an increase of about only 22 seconds compared to the above-described process of the cited reference. This result shows an increase of 13.8% in terms of the process time. However, since the two compression materials 100 are manufactured, the process time for each compression material is decreased to 91 seconds from the 160 seconds which are required for the manufacture of one compression material in the cited reference. This result indicates that 1.76 compression materials can be manufactured in 160 seconds, which is the time required for the manufacture of one compression material in the related art.

Embodiment 3

Figure 20:
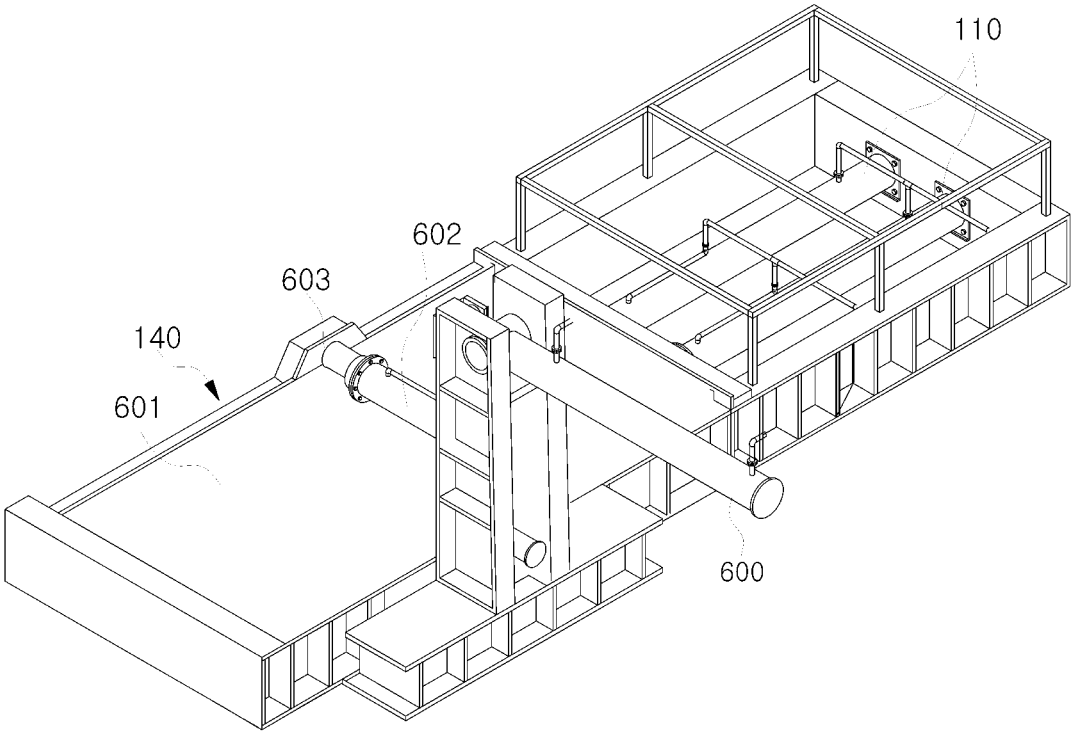
FIG. 20 is a perspective view showing the structure in which the cover of the compression chamber is opened and closed by the cover cylinder at one side unlike the former embodiments shown in FIG. 4, FIG. 6 and FIG. 13.

This embodiment of the present invention is based on the structure of Embodiment 2, except that, as shown in FIG. 20, the cover cylinder 600 which was disposed in the lengthwise direction of the compression chamber 140 is disposed at the side of the compression chamber 140, the locking cylinder 602 and the locking holes 603 are disposed at positions that correspond to the position of the cover cylinder 600, and a hinge shaft 604 is disposed on one edge of the cover 601.

According to this embodiment, it is of course possible to dispose the locking cylinders 602 and the locking holes 603 at both sides instead of disposing them at the center in FIG. 20.

According to this embodiment, when carrying out the operation of moving the cover 601 using the cover cylinder 601 so that the cover 601 is vertically erected or covers the compression chamber 140, the cover 601 of the cover cylinder 600 is not erected or laid in the lengthwise direction, but the piston of the locking cylinder 602 slides along only the short width of the compression chamber 140 that is equal to or shorter than the half of the length. Accordingly, the sliding length of the piston of the cover cylinder 600 is decreased to be half or less. This is shown in FIG. 21 to FIG. 23.

Figure 21:
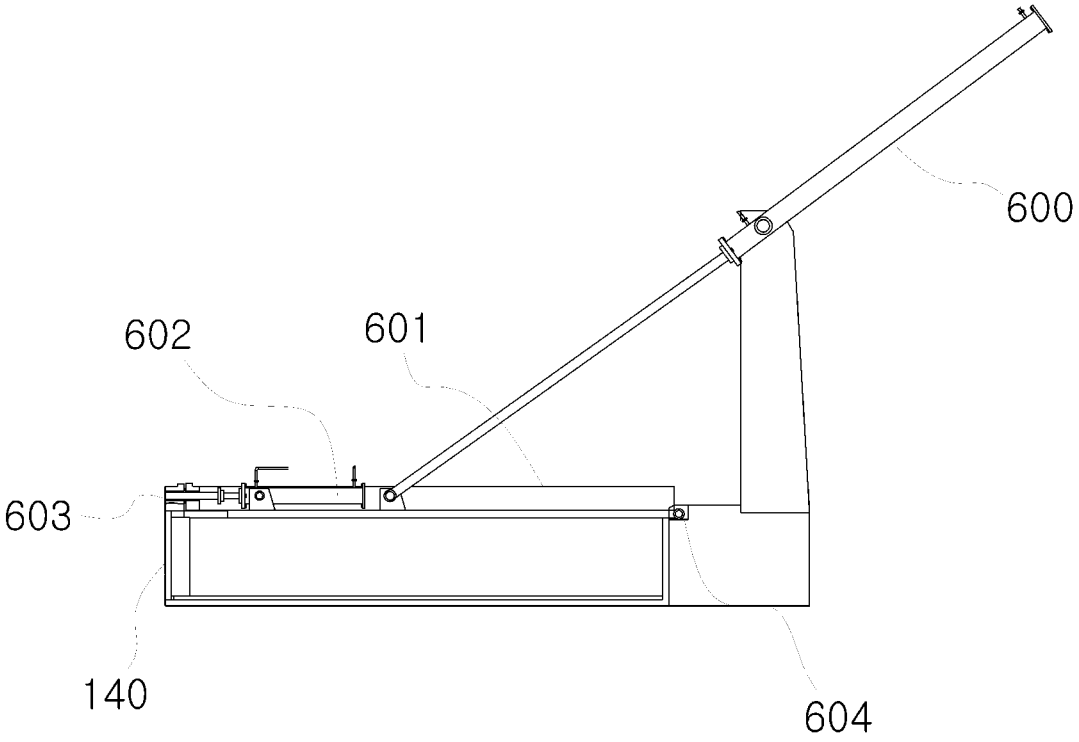
FIG. 21 is a side elevation view showing the state in which the cover is closed by the cover cylinder disposed at one side.
Figure 22:
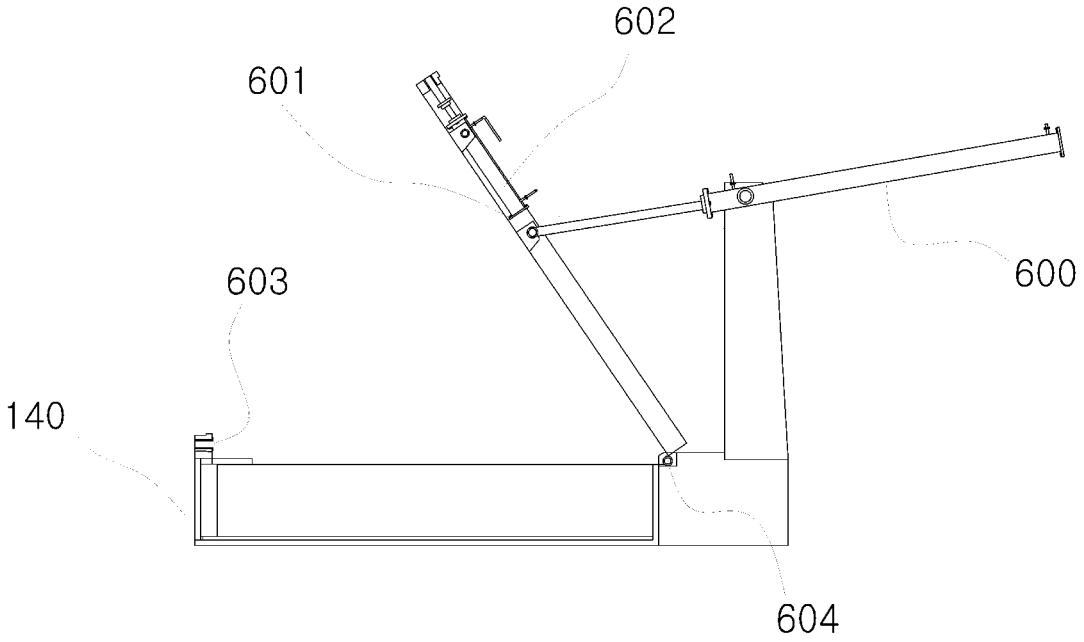
FIG. 22 is a side elevation view showing the state in which the cover is opened halfway by the cover cylinder disposed at one side.
Figure 23:
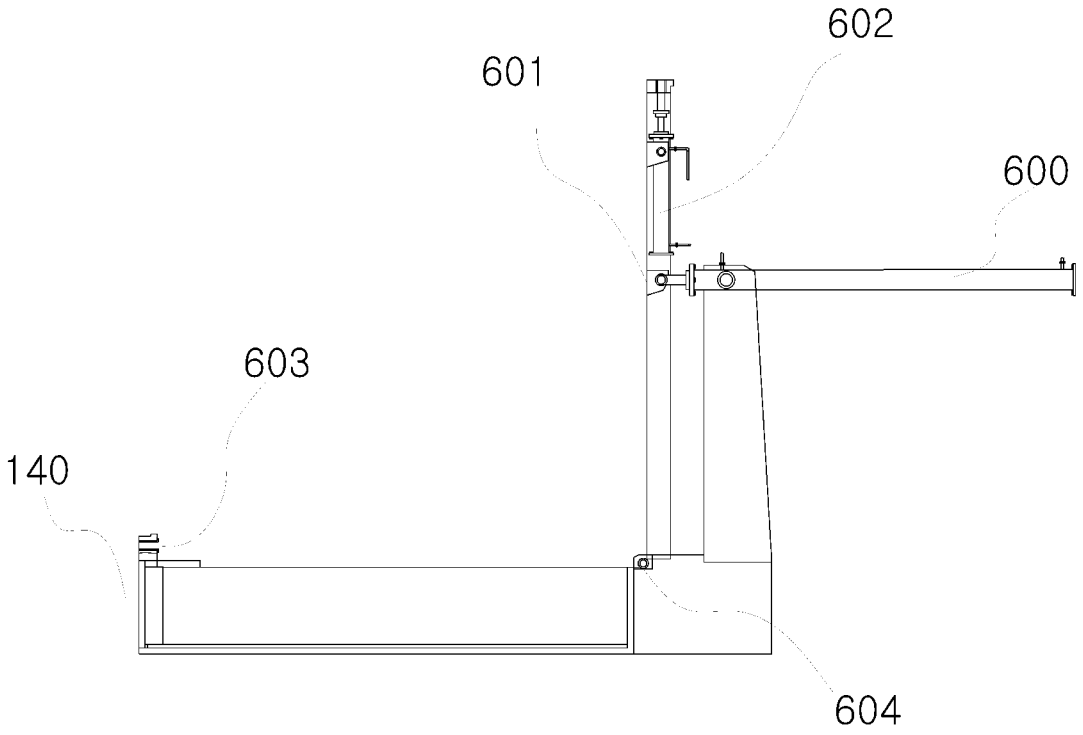
FIG. 23 is a side elevation view showing the state in which the cover is completely opened by the cover cylinder disposed at one side.

In other words, as shown in FIG. 21 to FIG. 23, when the cover cylinder 600 disposed at the side is actuated, the piston thereof slides so that the cover 601 is erected about the hinge shaft 604 fixed to the edge of the compression chamber 140 or the compression chamber 140 is closed with the cover 140.

According to this embodiment of the present invention as above, the operation time of the cover cylinder 600 for opening/closing the cover 601 is significantly decreased to be half or less, and the piston slides only the decreased distance. Therefore, the traditional times of 10 seconds and 13 seconds required for opening/closing the cover 601 can be decreased to 5 seconds, which does not exceed the half of the traditional times. In this case, as shown in FIG. 24, the process time can be further decreased. The experiment results are presented in the process time comparison table in FIG. 24. This shows that the embodiment shown in FIG. 20 in which the cover cylinder 601 is disposed at the side can realize an excellent effect in that it can manufacture two compression materials while decreasing the process time by 2 seconds compared to the above-described process of the cited reference.

This result shows that the two compression materials 100 can be manufactured while the process time is decreased by 1.25%. Accordingly, the time required for each material is decreased from 160 seconds to 79 seconds. This result indicates that 2.026 compression materials can be manufactured in 160 seconds, which is the time required for the manufacture of one compression material in the related art.

In addition, Embodiment 3 is based on Embodiment 2, except that the cover is fixed to the hinge shaft disposed at one edge of the compression chamber, the cover cylinder is disposed at the side of the cover, and the locking cylinder and the locking hole are disposed in the direction identical to that of the cover cylinder.

However, it is of course possible to embody a configuration which is based on the structure of Embodiment 1, in which the compression chambers are disposed at both sides of the first compression cylinder, and the core cylinders, the first press plates and the second press plates using the second compression cylinders are disposed in the compression chambers, except that the cover is fixed to the hinge shaft disposed at one edge of the compression chamber, that the cover cylinder is disposed at the side of the cover, and that the locking cylinder and the locking hole are disposed in the direction identical to that of the cover cylinder.

The present invention is not limited to the certain embodiments that have been described above, but various variations and changes are possible without departing from the concept and idea of the present invention.

The invention claimed is:

1. A double-acting apparatus for manufacturing metal scrap compression materials, comprising a core which is vertically erected in a central portion of a compression chamber, to form a through-hole in a compression material and a first press plate which is to be actuated by a first compression cylinder, and a second press plate which is to be actuated by a second compression cylinder, the second press plate being disposed so as to orthogonally intersect the first press plate, wherein:

third compression cylinders and third press plates are additionally disposed at both left and right end sides of the compression chamber about the first compression cylinder, and each length of the third compression cylinders which are disposed at both left and right end sides of the compression chamber is half of a length of the first compression cylinder which is disposed at a center of the apparatus.

2. A double-acting method for manufacturing metal scrap compression materials, in which first press plates are disposed at both sides of one first compression cylinder such that the first press plates slide in both compression chambers, two second compression cylinders are disposed at both ends of second compression chambers such that second compression is carried out by second press plates disposed on pistons of the second compression cylinders, either of upper portions of the compression chambers is opened and closed by a cover, and a core is vertically disposed with respect to either of bottoms of the compression chambers such that a though-hole is formed in a compression material by the core and a core cylinder during compression processes, the method comprising: lifting up the core of the core cylinder, loading metal scrap and closing the cover at one chamber side of the compression chambers while suspending the other chamber side of the compression chambers; carrying out the second compression using the second press plates at one chamber side of the compression chambers while opening the cover and discharging a compression material at the other chamber side of the compression chambers; suspending one chamber side of the compression chambers while lifting up the core of the core cylinder, loading metal scrap and closing the cover at the other chamber side of the compression chambers; continuously returning the first and second press plates and moving down the core at one chamber side of the compression chambers while first compressing the metal scrap using the first press plate at the other chamber side of the compression chambers; opening the cover and discharging a compression material at one chamber side of the compression chambers while second compressing the metal scrap using the second press plates at the other chamber side of the compression chambers; and repeating lifting up the core of the core cylinder at one chamber side of the compression chambers while suspending the other chamber side of the compression chambers.

3. A double-acting apparatus for manufacturing metal scrap compression materials, comprising a core which is vertically erected in a central portion of a compression chamber to form a through-hole in a compression material, and a first press plate which is to be actuated by a first compression cylinder, and a second press plate which is to be actuated by a second compression cylinder, the second press plate being disposed so as to orthogonally intersect the first press plate, wherein:

third compression cylinders and third press plates are additionally disposed at both left and right end sides of the compression chamber about the first compression cylinder, a cover is fixed to a hinge shaft disposed at one edge of the compression chamber, a cover cylinder is disposed at a side of the cover, a locking cylinder and a locking hole are disposed in a direction identical to that of the cover cylinder, and each length of the third compression cylinders which are disposed at both left and right end sides of the compression chamber is half of a length of the first compression cylinder which is disposed at a center of the apparatus.

* * * * *